US006162265A

United States Patent [19]

Dunlop et al.

[11] Patent Number: 6,162,265

[45] **Date of Patent: *Dec. 19, 2000**

[54] PROCESS FOR PROCESSING COAL

[75] Inventors: Donald D. Dunlop, Miami, Fla.; Leon C. Kenyon, Jr., Baton Rouge, La.

[73] Assignee: Fuels Management, Inc., Miami, Fla.

[ * ] Notice: This patent is subject to a terminal disclaimer.

[21] Appl. No.: 09/313,338

[22] Filed: May 17, 1999

Related U.S. Application Data

[63] Continuation-in-part of application No. 09/170,576, Oct. 13, 1998, Pat. No. 5,904,741, which is a continuation-in-part of application No. 08/928,858, Sep. 12, 1997, Pat. No. 5,830,247, which is a continuation-in-part of application No. 08/811,127, Mar. 3, 1997, Pat. No. 5,830,246.

[51] Int. Cl.[7] ..... C10L 1/32; C10L 9/00

[52] U.S. Cl. ..... 44/626; 44/620

[58] Field of Search ..... 44/626

[56] References Cited

U.S. PATENT DOCUMENTS

| | | | |
|---|---|---|---|
| 4,213,752 | 7/1980 | Seitzer | 432/14 |
| 4,309,192 | 1/1982 | Kubo et al. | 44/51 |
| 5,035,721 | 7/1991 | Altherton | 44/594 |
| 5,087,269 | 2/1992 | Cha et al. | 44/626 |
| 5,145,489 | 9/1992 | Dunlop | 44/626 |
| 5,503,646 | 4/1996 | McKenny et al. | 44/620 |
| 5,527,365 | 6/1996 | Coleman et al. | 44/626 |
| 5,556,436 | 9/1996 | Yagaki et al. | 44/626 |
| 5,587,085 | 12/1996 | Yoon et al. | 210/315 |
| 5,830,246 | 11/1998 | Dunlop | 44/626 |
| 5,830,247 | 11/1998 | Dunlop | 44/626 |
| 5,904,741 | 5/1999 | Dunlop et al. | 44/626 |

*Primary Examiner*—Ellen M. McAvoy
*Attorney, Agent, or Firm*—Howard J. Greenwald

[57] ABSTRACT

A process for preparing an irreversibly dried coal. In the first step of the process, a first fluidized bed reactor with a bed whose density is from about 30 to about 50 pounds per cubic foot and whose temperature is from about 480 to about 600 degrees Fahrenheit is contacted with a coal with a moisture content of from about 15 to about 30 percent, liquid phase water, inert gas, and air. The comminuted and dewatered coal produced in the first fluidized bed reactor is then passed to a second fluidized bed with a density of from about 30 to about 50 pounds per cubic foot and a temperature of from about 215 to about 250 degrees Fahrenheit, to which water, inert gas, and from about 0.5 to about 3.0 weight percent of mineral oil with an initial boiling point of at least about 900 degrees Fahrenheit is also fed; the temperature of the comminuted and dewatered coal is reduced to the temperature of from about 215 to about 250 degrees Fahrenheit in less than about 120 seconds.

20 Claims, 6 Drawing Sheets

PROCESS FOR PROCESSING COAL

CROSS-REFERENCE TO RELATED PATENT APPLICATIONS

This application is a continuation-in-part of U.S. patent application Ser. No. 09/170,576, filed on Oct. 13, 1998, now U.S. Pat. No. 5,904,741; which is a continuation-in-part of U.S. patent application Ser. No. 08/928,858, filed on Sep. 12, 1997, now U.S. Pat. No. 5,830,247; which, in turn, was a continuation-in-part of U.S. patent application application Ser. No. 08/811,127, filed on Mar. 3, 1997, now U.S. Pat. No. 5,830,246.

FIELD OF THE INVENTION

A process for irreversibly removing moisture from coal while simultaneously reducing its particle size.

BACKGROUND OF THE INVENTION

Many coals contain up to about 30 weight percent of moisture. This moisture not only does not add to the fuel value of the coal, but also is relatively expensive to transport.

Consequently, many processes have been developed to dry coal. Illustrative of these processes is the one disclosed in U.S. Pat. No. 4,324,544 of Blake, in which coal is dried in a fluidized bed in which the heat necessary for drying is provided by partial combustion of the coal in the bed. In the process of this Blake patent, after dried coal is withdrawn from a fluidized bed, it is maintained in a substantially inert off-gas atmosphere and thereafter cooled to a temperature below 140 degrees Fahrenheit. This inert atmosphere must be used because of pyrophoric nature of the coal makes it susceptible to spontaneous combustion.

Furthermore, the Blake patent teaches that its process should only be used with relatively fine coal, i.e., coal less than 8 mesh. At lines 30–35 of Column 4 of the Blake patent, it is disclosed that " . . . the above reaction rate constants were calculated from coal ground to below 8 mesh. The combustion rate appears to be limited by the amount of coal surface exposed to the fluidizing gas and, therefore, larger coal particles will probably oxidize less rapidly."

The coal produced by the processes of the prior art tends to suffer from several disadvantages. In the first place, the drying processes used to produce them often are reversible, and when the coal is allowed to stand in the presence of a moisture-laden atmosphere, it regains some or all of its initial water content. In the second place, the coal is often likely to undergo spontaneous combustion upon standing in air.

It is an object of this invention to provide a process for irreversibly removing moisture from coal which does not require substantial amounts of externally provided energy to drive it.

It is an object of this invention to provide a process for irreversibly removing moisture from coal which does not require one to reduce the particle size of the coal to 8 mesh prior to drying it.

It is another object of this invention to provide a process for producing coal which is not likely to undergo spontaneous combustion.

It is yet another object of this invention to provide a process for comminuting coal without using mechanical grinding means.

It is yet another object of this invention to provide a coal which, even after it is stored under ambient conditions for prolonged periods of time, has a relatively high heating value.

It is another object of this invention to provide an economical, relatively simple process for producing marketable coal from low rank coal.

It is yet another object of this invention to provide a process for producing marketable coal-liquid slurry from low rank coal.

It is yet another object of this invention to provide a novel coal-water slurry.

SUMMARY OF THE INVENTION

In accordance with this invention, there is provided a process for preparing an irreversibly dried coal. In the first step of this process, there is provided a fluidized bed reactor with a fluidized bed density of from about 30 to about 50 pounds per cubic feet, wherein said reactor is at a temperature of from about 480 to about 600 degrees Fahrenheit. To this reactor is fed coal with a moisture content of from about 15 to about 30 percent, an oxygen content of from about 10 to about 25 percent; and it is subjected to a temperature of from about 480 to about 600 degrees Fahrenheit for from about 1 to about 5 minutes while liquid phase water, inert gas, and air are fed to the reactor; in one embodiment, solid material from a cyclone is cooled and discharged. The comminuted and dewatered coal is passed to a second fluidized bed reactor with a fluidized bed density of from about 30 to about 50 pounds per cubic foot and a reactor temperature of from about 215 to about 250 degrees Fahrenheit. Also fed to this second fluidized bed reactor is from about 0.5 to about 3.0 weight percent of mineral oil; the temperature of the coal is reduced to the 215–250 F. temperature in less than about 120 seconds.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
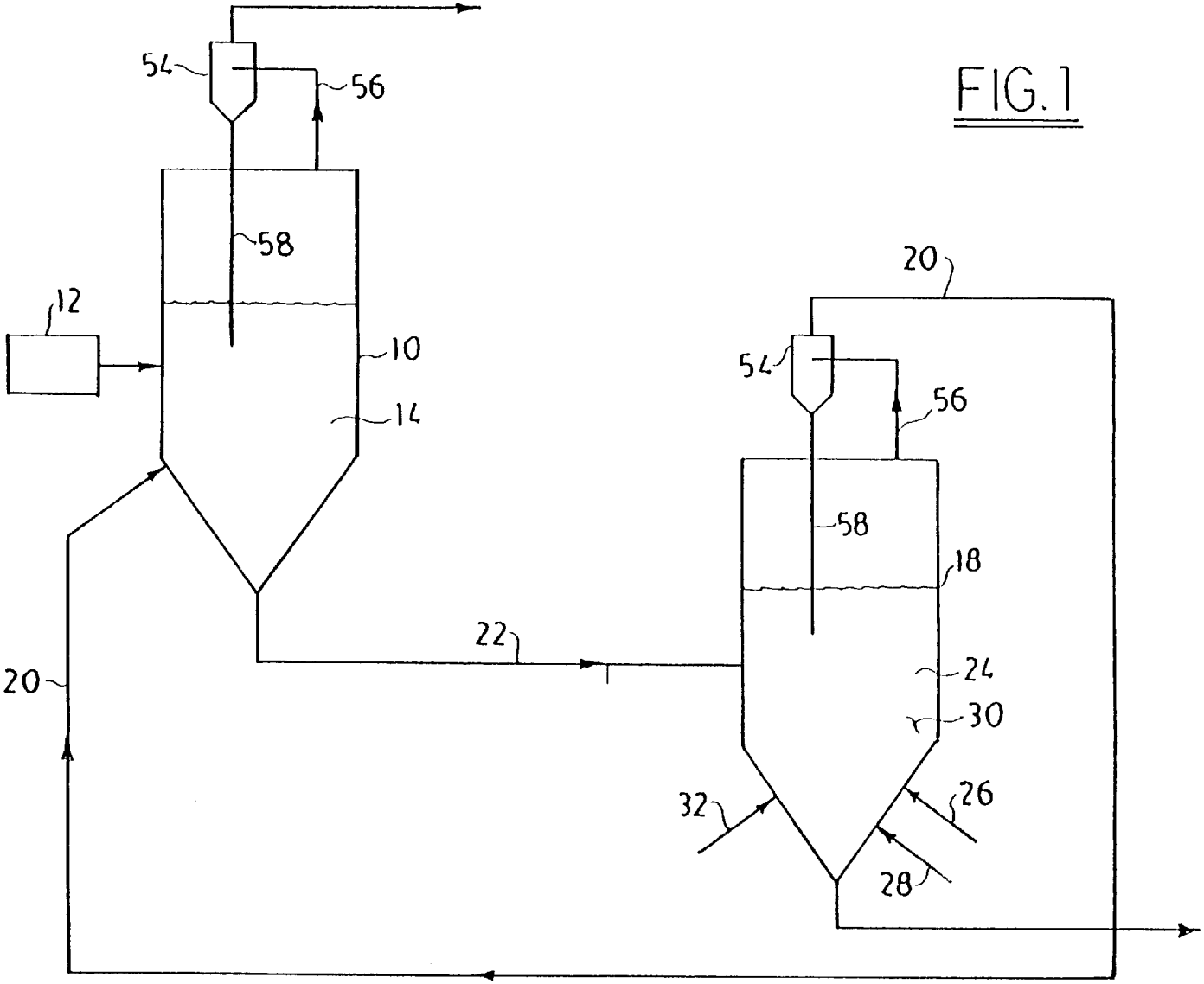
FIG. 1 is a schematic diagram of one preferred process of the instant invention.
Figure 2:
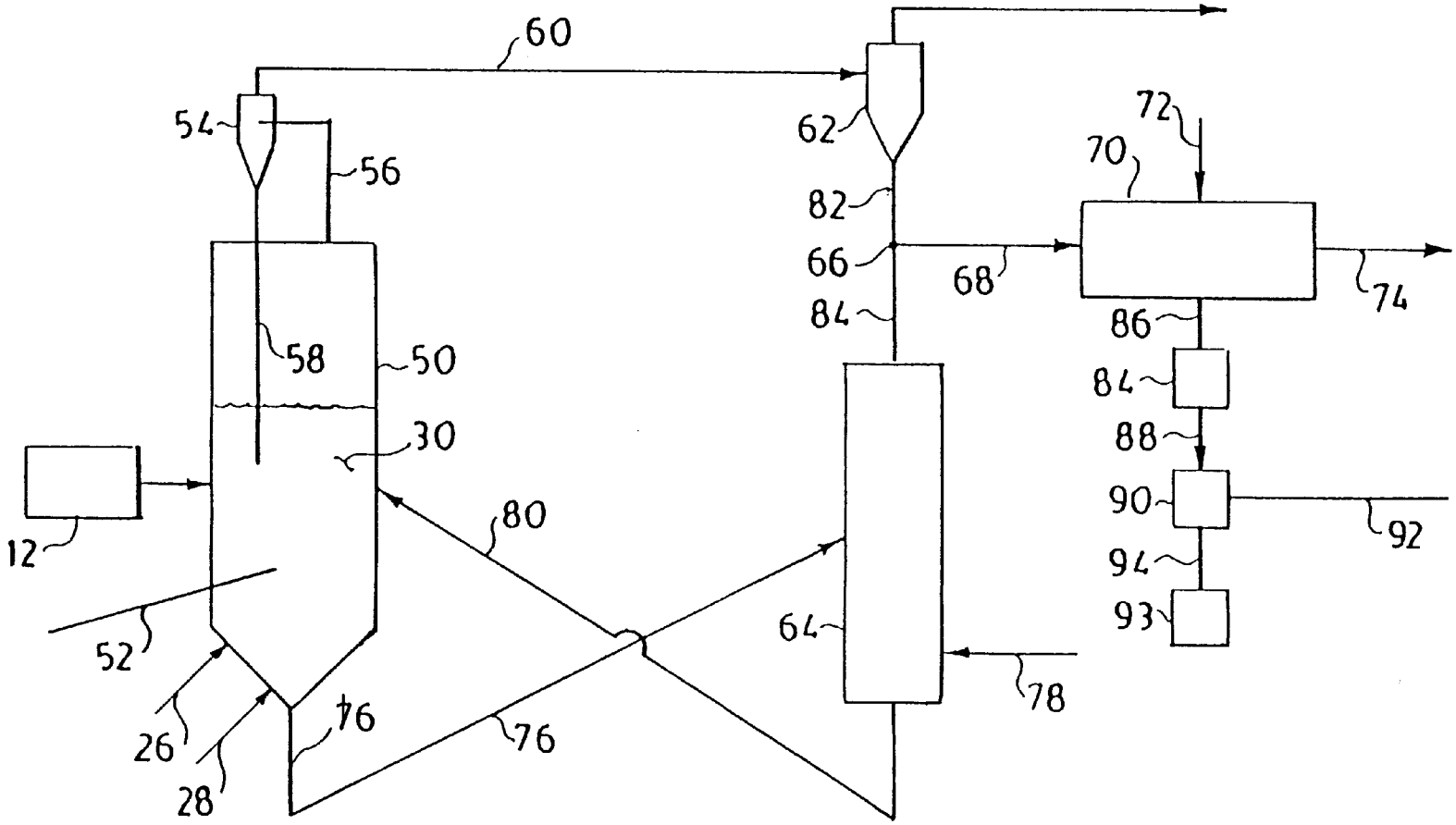
FIG. 2 is a schematic diagram of another preferred process of the instant invention.

At least four different processes are described in this specification. The first of such processes, illustrated in FIG. 1, is especially suitable for making a marketable coal from low rank coal. The second of these processes, illustrated in FIG. 2, is especially suitable for producing a marketable coal-fluid slurry from low rank coal, which normally contains 30 weight percent of water. Another of these embodiments, which is described in FIG. 6, involves the step of directing solid material from a a reactor cyclone to a cooler and thereafter discharging it.

A First Process for Producing Marketable Coal from Low Rank Coal

In the preferred process illustrated in FIG. 1, in which a low rank coal is treated to produce a marketable coal, is an economical process which produces irreversibly dried coal which is not susceptible to spontaneous combustion. In this process, the amount of coal fines in the finished product is minimized.

Referring to FIG. 1, a particular coal is charged to a fluidized bed reactor 10, preferably by means of a coal feeder 12. It is essential that the coal used in this process have certain properties. If other coals are used, the process will not function as well.

It is preferred that the coal used in the process of FIG. 1 contain from about 15 to about 30 weight percent of moisture and, more preferably, from about 20 to about 30 weight percent of moisture. As is known to those skilled in the art, the moisture content of coal may be determined by standard A.S.T.M. testing procedures. Means for determining the moisture content of coal are well known in the art; see, e.g., U.S. Pat. No. 5,527,365 (irreversible drying of carbonaceous fuels), U.S. Pat. Nos. 5,503,646, 5,411,560 (production of binderless pellets from low rank coal), U.S. Pat. Nos. 5,396,260, 5,361,513 (apparatus for drying and briquetting coal), U.S. Pat. No. 5,327,717, and the like. The disclosure of each of these United States patents is hereby incorporated by reference into this specification.

It is also preferred that the coal used in the process of FIG. 1 contain at least about 10 weight percent of combined oxygen and, more preferably, from about 10 to about 20 weight of combined oxygen, in the form, e.g., of carboxyl groups, carbonyl groups, hydroxyl groups, and the like. As used in this specification, the term "combined oxygen" means oxygen which is chemically bound to carbon atoms in the coal. See, e.g., H. H. Lowry, Editor, "Chemistry of Coal Utilization" (John Wiley and Sons, Inc., New York, N.Y., 1963). Without wishing to be bound to any particular theory, applicant believes that his process will not function well unless the coal contains at least 10 weight percent of combined oxygen.

The combined oxygen content of coal may be determined by standard analytical techniques such as, e.g., U.S. Pat. Nos. 5,444,733, 5,171,474, 5,050,310, 4,852,384 (combined oxygen analyzer), U.S. Pat. No. 3,424,573, and the like. The disclosure of each of these United States patents is hereby incorporated by reference into this specification.

In one embodiment, the coal charged to reactor 10 contains at least about 10 weight percent of ash. Thus, e.g., in this embodiment one may use Wyodak C coal from Wyoming.

The term ash, as used in this specification, refers to the inorganic residue left after the ignition of combustible substances; see, e.g., U.S. Pat. No. 5,534,137 (high ash coal), U.S. Pat. No. 5,521,132 (raw coal fly ash), U.S. Pat. No. 4,795,037 (high ash coal), U.S. Pat. No. 4,575,418 (removal of ash from coal), U.S. Pat. No. 4,486,894 (method and apparatus for sensing the ash content of coal), and the like. The disclosure of each of these United States patents is hereby incorporated by reference into this specification.

Referring again to FIG. 1, the coal which is added to feeder assembly 12 may be, e.g., lignite, sub-bituminous, and bituminous coals. These coals are described in applicant's U.S. Pat. No. 5,145,489, the entire disclosure of which is hereby incorporated by reference into this specification.

The coal charged to reactor 10 preferably is 2"×0", and more preferably 2" by ¼" or smaller. As is known to those skilled in the art, 2" by ¼" coal has all of its particles within the range of from about 0.25 to about 2.0 inches.

As is known to those skilled in the art, crushed coal conventionally has the 2"×0" particle size distribution. This crushed coal can advantageously be used in applicant's process. The process of U.S. Pat. No. 4,324,544 of Blake, by comparison, requires coal which has been ground to 8 mesh or smaller.

Referring again to FIG. 1, the coal is fed into feeder 12. Feeder 12 can be any coal feeder commonly used in the art. Thus, e.g., one may use one or more of the coal feeders described in U.S. Pat. Nos. 5,265,774, 5,030,054 (mechanical/pneumatic coal feeder), U.S. Pat. No. 4,497,122 (rotary coal feeder), U.S. Pat. Nos. 4,430,963, 4,353,427 (gravimetric coal feeder), U.S. Pat. Nos. 4,341,530, 4,142,868 (rotary piston coal feeder), U.S. Pat. No. 4,140,228 (dry piston coal feeder), U.S. Pat. No. 4,071,151 (vibratory high pressure coal feeder with helical ramp), U.S. Pat. No. 4,149,228, and the like. The disclosure of each of these United States patents is hereby incorporated by reference into this specification.

Referring again to FIG. 1, feeder 12 is comprised of a hopper (not shown) and a star feeder (not shown). It is preferred that feeder 12 be capable of continually delivering coal to fluidized bed 10.

In one embodiment, not illustrated, a star feeder is used. A star feeder is a metering device which may be operated by a controller which controls the rate of coal removal from a hopper; see, e.g., U.S. Pat. No. 5,568,896, the entire disclosure of which is hereby incorporated by reference into this specification.

Referring again to FIG. 1, a fluidized bed 14 is provided in a reactor vessel 10. The fluidized bed 14 is comprised of a bed of fluidized coal particles, and it preferably has a density of from about 20 to about 40 pounds per cubic foot. In one embodiment, the density of the fluidized bed 20 is from about 20 to about 30 pounds per cubic foot. The fluidized bed density is the density of the bed while its materials are in the fluid state and does not refer to the particulate density of the materials in the bed.

Fluidized bed 14 may be provided by any of the means well known to those skilled in the art. Reference may be had, e.g., to applicant's U.S. Pat. Nos. 5,145,489, 5,547,549, 5,546,875 (heat treatment of coal in a fluidized bed reactor), U.S. Pat. No. 5,197,398 (separation of pyrite from coal in a fluidized bed), U.S. Pat. No. 5,087,269 (drying fine coal in a fluidized bed), U.S. Pat. No. 4,571,174 (drying particulate low rank coal in a fluidized bed), U.S. Pat. No. 4,495,710 (stabilizing particulate low rank coal in a fluidized bed), U.S. Pat. No. 4,324,544 (drying coal by partial combustion in a fluidized bed), and the like.

Fluidized bed 14 is preferably maintained at a temperature of from about 150 to about 200 degrees Fahrenheit. In a more preferred embodiment, the fluidized bed 14 is maintained at a temperature of from about 165 to about 185 degrees Fahrenheit. Various means may be used to maintain the temperature of fluidized bed 14 at a temperature of from about 150 to about 200 degrees Fahrenheit. Thus, e.g., one may use an internal or external heat exchanger (not shown). See, e.g., U.S. Pat. Nos. 5,537,941, 5,471,955, 5,442,919, 5,477,850, 5,462,932, and the like.

In one embodiment, illustrated in FIG. 1, hot gas from, e.g., a separate fluidized bed reactor 18 is fed via line 20 into fluidized bed 14. This hot gas preferably is at temperature of from about 480 to about 600 degrees Fahrenheit and, more preferably, at a temperature of from about 525 to about 575 degrees Fahrenheit.

The coal removed from fluidized bed 14 is partially dehydrated. The untreated coal charged to reactor 10 generally has a moisture content of from about 25 to about 30 weight percent. The coal which is removed from fluidized bed 14 generally contains no more than about 15 weight percent moisture.

The partially dehydrated coal is passed via line 22 to fluidized bed reactor 18, in which a fluidized bed 24 is preferably maintained at a temperature of from about 480 to about 600 degrees Fahrenheit and, more preferably, from about 525 to about 575 degrees Fahrenheit.

In addition to dehydrated coal being charged via line 22 to bed 24, one also charges air via line 26, water via line 28, and oil via line 32. In one embodiment, the fluidized bed 24 is fluidized with the air introduced via line 26, and the temperature of the bed is controlled with the water introduced via line 28.

The dehydrated coal, air, and water are introduced at rates sufficient to produce a fluidized bed with a density of from about 20 to about 40 pounds per cubic foot and, more preferably, from about 25 to about 35 pounds per cubic foot.

Thus, air may be flowed into the system via line 26. The air may be at ambient temperature, or it may be heated, as required, to maintain the desired temperature.

Thus, e.g., liquid water may be introduced via line 28. Again, depending upon the temperature control desired, the liquid water may be at ambient temperature.

The quantities of air and/or water, and their temperatures, may be varied to maintain the desired temperature within the fluidized bed 24.

The temperature within fluidized bed 24 may be monitored by conventional means such as, e.g., by means of thermocouple 30.

The coal fed to fluidized bed 24 via line 22 preferably is maintained in fluidized bed 24 for from about 1 to about 5 minutes, and preferably for from about 2 to about 3 minutes, while being subjected to the aforementioned temperature of from about 480 to about 600 degrees Fahrenheit.

Referring again to FIG. 1, oil is fed via line 32 into fluidized bed 24. The oil used in the process preferably has an initial boiling point of at least 900 degrees Fahrenheit. Thus, e.g., one may use a mineral oil with an initial boiling point of at least 900 degrees Fahrenheit.

Mineral oils are derived from petroleum coal, shale and the like and consist essentially of hydrocarbons. Thus, e.g., one may use residual fuel oil, heavy crude oil, coal tars, and the like, as long as they have an initial boiling point at least 900 degrees Fahrenheit. The initial boiling point of a mineral oil is the recorded temperature when the first drop of distilled vapor is liquefied and falls from the end of the condenser. See, e.g., U.S. Pat. No. 5,451,312 (initial boiling point of a hydrocarbon fraction), U.S. Pat. No. 5,382,728 (initial boiling point of a hydrocarbon blend), U.S. Pat. Nos. 5,378,739, 5,370,808 (initial boiling point of a petroleum oil), and the like.

In one embodiment, the oil used is residual fuel oil. Residual fuel oil, which is often referred to as "residual oil," refers to the combustible, viscous, or semiliquid bottoms produced from crude oil distillation. see, e.g., U.S. Pat. Nos. 4,512,774, 4,462,810, 4,404,002, 4,297,110, 3,977,823, 3,691,063, and the like.

The oil fed via line 32 preferably is fed at rate so that, within fluidized bed 24, from about 0.5 to about 3.0 weight percent of such oil is present, based upon the weight of dried coal withdrawn from fluidized bed 24 via line. Thus, e.g., for every 100 parts of dried coal withdrawn from fluidized bed 24 per unit of time, from about 0.5 to about 3.0 parts of oil would be contained thereon and, thus, would have to be introduced via line 32 to produce the desired condition.

The dried coal produced in applicant's process contains from about 0.5 to about 3.0 weight percent of oil (by weight of dried coal), and from about 0 to about 2.0 weight percent of moisture.

Applicant has discovered that, unexpectedly, the use of his process produces a comminution of the coal fed into the fluidized bed. It is believed that the coal is caused to disintegrate by the escape of steam from the coal at an extremely high rate.

In one embodiment, not shown, the comminution of the coal is enhanced by conventional attrition devices. It is known to those that attrition may be increased by the addition of impact targets or other such devices.

The coal produced by applicant's process is irreversibly dried. Thus, when such coal is allowed to sit in an environment at a temperature of 25 degrees Centigrade at a relative humidity of exceeding 50%, it will pick up less than 2.0 percent of moisture from this environment in 48 hours.

In one embodiment, the dried coal produced by applicants' process contains from about 0 to about 2 weight percent of moisture, from about 8 to about 10 weight percent of ash, from about 36 to 39 weight percent of volatile matter, and from about 50 to about 65 weight percent of carbon.

In one aspect, the dried coal produced by this embodiment contains a relatively large amount of volatile matter. Volatile matter is any material which volatilizes at a temperature of 900 degrees Centigrade in an inert atmosphere, and its presence in coal may be analyzed by conventional means. See, e.g., U.S. Pat. Nos. 5,605,722, 5,601,631, 5,568,777, 5,551,958, 5,512,074, 5,435,983, 5,389,117, 5,374,297, 5,366,537, 4,459,103 (automatic volatile matter content analyzer), U.S. Pat. No. 4,257,778 (process for preparing coal with a high volatile matter content), and the like.

Applicants believe that the volatile matter in the dried coal produced by this aspect of the invention contains organic materials.

A Process for Producing Liquid Fuel

In the process described in this portion of the specification, a coal product with increased fines content is produced. FIG. 2 is a schematic representation of this process, which is especially suitable for producing a coal/liquid slurry from the low rank coal.

As is discussed in U.S. Pat. No. 5,145,489, the most abundant coal resource in western North America and Canada is the low rank coals.

The process described in this section of the specification enables one to produce a combustible, high-quality coal-water slurry from low rank coals. Making a high-solids content slurry from coal which already contains about 30 weight percent of moisture is no easy task.

Referring to FIG. 2, the low rank coal described elsewhere in the specification is fed into feeder 12 and thence into fluidized bed reactor 50. Air is fed into reactor 50 via line 26 and a sufficient rate vis-a-vis the coal feed to maintain the fluidized bed 52 so that its temperature is from about 480 to about 600 degrees Fahrenheit and its density is from about 20 to about 40 pounds per cubic foot. Water is fed to the fluidized bed 52 via line 28 as necessary to provide temperature control.

The fluidized bed 52 is substantially identical to the fluidized bed 24 (see FIG. 1) with the exception that the coal fed to bed 52 is not at least partially dehydrated, and with the additional exception that the coal fed to bed 52 is not at least partially comminuted. In general, the coal fed to bed 52 contains at least about 25 weight percent of moisture, depending upon ambient conditions, and frequently contains at least about 30 weight percent of moisture. Furthermore, the coal fed to bed 52 generally has a particle size in the range of from 2" by 0".

Applicants believe that the use of this wetter, coarser coal in the fluidized bed 52 will cause a greater degree of comminuition than that occurring in fluidized bed 24.

It is believed that the finer coal portions will be entrained from the top of the fluid bed 52 to the cyclone 54, via line 56. The coarser component of the entrained stream will be returned to the fluidized bed 52 via line 58.

One may use any of the cyclones conventionally used in fluid bed reactors useful for separating solids from gas. Thus, e.g., one may use as cyclone 54 the cyclones described in U.S. Pat. No. 5,612,003 (fluidized bed with cyclone), U.S. Pat. No. 5,174,799 (cyclone separator for a fluidized bed reactor), U.S. Pat. Nos. 5,625,119, 5,562,884, and the like.

The fine portion from cyclone 54 is passed via line 60 a second cyclone 62. The fine portion from cyclone 62 is contacted with a fine portion from elutriator 64 at point 66, and the mixture thus produced is then passed via line 68 to quench vessel 70, wherein water is added via line 72. The quenched product is then passed via line 74 to a coal-water fuel preparation plant (not shown).

Referring again to FIG. 2, comminuted coal from fluid bed 52 is passed via line 76 to elutriator 64. The function of elutriator 64 is to separate fine particles from coarser particles by means of gravity.

One may use any of the elutriators known to those skilled in the art. Thus, e.g., one may use one or more of the elutriators disclosed in U.S. Pat. Nos. 5,518,188, 5,497,949, 4,755,284, 4,670,002, 4,350,283, 3,825,175, 3,482,692, and the like.

Air is added to elutriator 64 via line 78 and acts as the elutriating gas. The coarse fraction from elutriator 64 is recycled and passed via line 80 back to fluidized bed 52 for additional comminution.

Elutriating gases other than air may be used. Thus, e.g., one may alternatively or additionally use flue gas.

The cyclone separator 62 is designed to capture any solids which leave cyclone 54 via overhead line 60 and to return them to the system. These solids are passed via line 82, where the stream of solids contacts a stream of gas and solids from elutriator 64 (via line 84) at point 66.

The mixture of materials from lines 82 and 84 is passed via line 68 to quench 70, wherein it is contacted with water which introduced into quencher 70 via line 72. It is preferred that the water be at ambient temperature, and it is preferred that be introduced at a rate sufficient to reduce the temperature of the coal particles within about 5 seconds to ambient temperature.

Applicants believe that this rapid cooling effects further comminution of the coal particles.

In one embodiment, depicted in FIG. 2, the coal from quencher 70 is passed to a mixer/grinder/blender 84 via line 86 wherein it may be mixed with one or more additional coal fractions to obtain any desired particle size distribution.

In one embodiment, the blending occurs in such manner to approach the particle size distribution disclosed in U.S. Pat. No. 4,282,006. If the nature of the coal fraction(s) in mixer/grinder/blender is not suitable for making such particle size distribution, the coal may be further ground as disclosed in such patent.

The slurry produced in applicant's process possesses some unexpected, beneficial results. It is substantially more combustible than prior art slurries.

Referring again to FIG. 2, after the coal segments have been blended in blender 84 they then may be beneficiated in a froth flotation cell or other conventional coal cleaner 90. Froth flotation cleaning of coal is well known; see, e.g., U.S. Pat. Nos. 5,379,902, 4,820,406, 4,770,767, 4,701,257, 4,676,804, 4,632,750, 4,532,032, and the like. The ash may be removed from froth flotation cell 90 via line 92, and the cleaned coal may be passed to slurry preparation tank 93 via line 94.

In one embodiment of this invention, the cleaned coal is used to prepare a coal-water slurry in accordance with the teachings of U.S. Pat. No. 4,477,259. This slurry preferably contains from about 60 to about 82 weight percent of coal, from about 18 to about 40 weight percent of carrier liquid (such as, e.g., water), and from about 0.1 to about 4.0 weight percent, by weight of dry coal) of dispersing agent. This slurry preferably has a specific surface area of from about 0.8 to about 4.0 square meters per cubic centimeter and an interstitial porosity of less than 20 volume percent. In one aspect of this embodiment, the slurry has a particle size distribution such that from about 5 to about 70 weight percent of the particles of coal in the slurry are of colloidal size, being smaller than about 3 microns.

Another Preferred Process of the Invention

Figure 3:
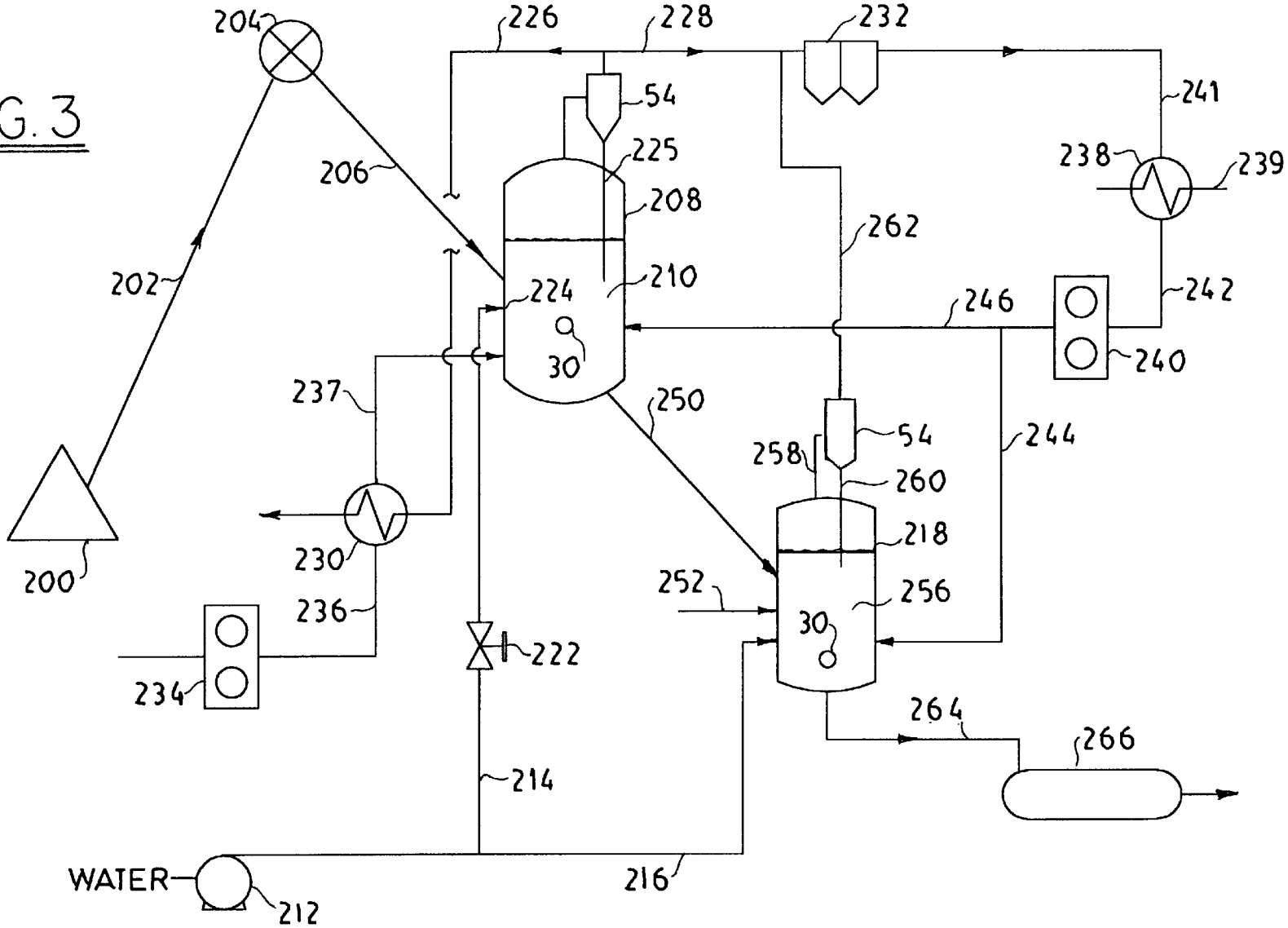
FIG. 3 is a schematic diagram of yet another preferred process of the instant invention.

FIG. 3 is a schematic diagram illustrating yet another preferred process of this invention.

Referring to FIG. 3, and in the preferred embodiment depicted therein, raw coal is charged from coal pile 200 via line 202 to feeder 204. The raw coal used in this process is similar to the raw coal used in the process depicted in FIG. 1 of this case; and it preferably contains the same amounts of moisture, combined oxygen, and ash as that described elsewhere in this specification. Thus, e.g., the raw coal charged to feeder 204 is preferably 2"×0" or smaller. Thus, as is also indicated elsewhere in this specification, one may charge low rank coals such as lignite and/or subbituminous coals to feeder 204.

Referring again to FIG. 3, feeder 204 is preferably a star feeder, but the other feeders and/or feeding means described elsewhere in this specification also can be used. Coal is fed from feeder 204 via line 206 to fluidized bed reactor 208.

The fluidized bed reactor 208 depicted in FIG. 3 is similar to the fluidized bed reactors illustrated in FIGS. 1 and 2 but differs slightly in the composition of its fluidized bed. In the preferred embodiment depicted in FIG. 3, the fluidized bed 210 is comprised of a bed of fluidized coal particles with a density of from about 30 to about 50 pounds per cubic foot.

The fluidized bed 210 is preferably maintained at a temperature of from about 480 to about 600 degrees Fahrenheit, and most preferably at from about 550 to about 600 degrees Fahrenheit. When the reaction temperature is too low, i.e., less than about 480 degrees Fahrenheit, the reaction rate is extremely slow. When the reaction rate is too high, i.e., greater than 600 degrees Fahrenheit, decomposition of the coal starts to occur and produces undesirable product with relative low volatility. It is difficult, however, to maintain the reaction temperature at less than about 600 degrees Fahrenheit because many of the reactions which occur within fluidized bed 21 are exothermic. In applicants' process, liquid water may be used to both maintain the desired temperature while not adversely affecting the degree of dehydration in the coal product produced.

Referring again to FIG. 3, it will be seen that a pump 212 pumps water (not shown) via lines 214 and 216; the former line 214 feeds water to reactor 208, and the latter line 216 feeds water to dryer 218.

The water fed via lines 214 and 216 preferably is in the liquid phase and at ambient temperatures higher and lower than ambient also may be used.

A sensor 30 is disposed in fluidized bed 210. When it is determined that the fluidized bed temperature is higher than desired (i.e., in excess of about 600 degrees Fahrenheit), a valve 222 is opened, pump 212 is actuated, and a sufficient amount of water is introduced into reactor 208 to maintain the temperature within the desired range. As will be apparent to those skilled in the art, conventional control and feedback means can be used to insure that the temperature within bed 210 is always within the desired range of from about 480 to about 600 degrees Fahrenheit.

In the preferred embodiment illustrated in FIG. 3, the water is shown entering fluidized bed 210 only at point 224. As will be apparent to those skilled in the art, in other embodiments the water may be introduced at a multiplicity of points within the fluidized bed 210 to improve the efficiency of its temperature regulation.

In the preferred process illustrated in FIG. 3, and depending upon other reaction variables, the water may be added none of the time, some of the time, or all of the time. The amount of water in the coal being treated is one variable which will affect the extent to which water must be added during the process.

Referring again to FIG. 3, and in the preferred embodiment depicted therein, the finer coal portions entrained from fluidized bed 210 are separated in cyclone 54. The solids so separated are passed black into fluidized bed 210 via standpipe 225. The off gas so separated is preferably passed via line 226 and 228 to heat exchanger 230 and baghouse 232, respectively.

The heat exchanger 230 is used to preheat incoming air fed from compressor 234 via line 236. Preferably such incoming air is preheated to a temperature of from about 400 to about 550 degrees Fahrenheit and, more preferably, from about 450 to about 500 degrees Fahrenheit.

Without wishing to be bound to any particular theory, applicants believe that the preheated air, which is fed via line 237 to fluidized bed 210, helps regulate the temperature of the fluidized bed 210, especially within the range of from about 550 to about 600 degrees Fahrenheit, and thereby helps insure the production of dried coal with a suitable degree of volatility under favorable economic conditions.

Referring again to FIG. 3, it will be seen that the off gas from cyclone 54 is passed via line 228 to baghouse 232, in which coal fines and other fine particles are collected. These particles may be blended back with the desired product, or disposed of as waste, or used in other processes well known to those in the art.

Exhaust gas from baghouse 232 is passed via line 234 or 236. Thus, e.g. this exhaust gas may be vented via line 241 and/or recycled to heat exchanger 238. When the amount of carbon monoxide in the exhaust exceeds limits set forth by the Environmental Protection Agency (e.g., up to about 0.1 percent), a portion of the exhaust gas is recycled and used in, e.g., a heat exchanger 238, a utility boiler (not shown), a catalytic converter (not shown), and the like. In the embodiment depicted in FIG. 3, cooling water is fed via line 239 into the heat exchanger 238.

As will be apparent, when saturated gas is cooled in heat exchanger 238 and/or heat exchanger 230, water condenses. This water may be removed by suitable means.

The dried exhaust gas passing through heat exchanger 238 is preferably fed via line 242 to blower 240, and thereafter the dried exhaust is fed via lines 244 and 246 to cooler 218 and reactor 208, respectively. This gas may be used, as needed, to maintain fluidization within bed 210 and/or to control the oxygen content within bed 210.

The oxygen content within bed 210 will affect the reaction rate of the reactions occurring within such bed 210 which, in turn, will control the temperature of the bed. Thus one may, in addition to the use of water, use the inert exhaust gas as a supplemental means of controlling the reaction temperature.

Referring again to FIG. 3, dried coal from fluidized bed 210 is passed via line 250 to cooler 218. It is preferred that the dried coal passed via line 250 contain less than about 1 weight percent of moisture. Generally, such dried coal will be at a temperature of from about 550 to about 600 degrees Fahrenheit.

It is preferred to cool the dried coal from its temperature of, e.g., about 550 to about 600 degrees Fahrenheit to a temperature of from about 215 to about 250 degrees Fahrenheit in less than about 120 seconds and, more preferably, in less than about 60 seconds. In order to effectively and economically achieve this cooling, applicants have discovered that they can use liquid water (fed via line 216) in conjunction with inert recycle gas (fed via line 244) and mineral oil with an initial boiling point of at least about 900 degrees Fahrenheit (which is fed via line 252).

Without wishing to be bound to any particular theory, applicants believe that the mineral oil serves two major functions. In the first place, it is believed that the mineral oil coats the surfaces of the coal particles and prevents them from absorbing water. In the second place, it is believed that it passivates the coal particles, preventing them from spontaneously combusting.

In addition to the mineral oil, and/or in replacement of some or all of the mineral oil, one may use other agents which passivate the coal particles and prevent their absorption of water. By way of illustration and not limitation, such other passivating agents include organic polymers which preferably are liquid under ambient conditions.

In one preferred embodiment, mineral oil is used as the passivating agent. This mineral oil is described in detail elsewhere in this specification. It is preferred to feed this oil at a rate such that, within fluidized bed 210, from about 0.5 to about 3.0 weight percent of such oil is present, based upon the weight of dried coal within bed 210 from line 250.

In one embodiment, mineral oil is not added to line 252. In this embodiment, despite the fact that this oil addition step is omitted, the ability of the dried coal to absorb water, while not entirely eliminated, is partially reduced.

Referring again to FIG. 3, it will be seen that the finer coal portions within cooler 218 will be entrained from the top of the fluidized bed 256 to the cyclone 54 via line 258. The coarser component of the entrained stream will be returned to the fluidized bed 256 via line 260. The exhaust gas from cyclone 54 is passed via line 262 to baghouse 232.

In general, one will add sufficient amounts of water, coal, and inert gas to maintain the fluidized bed at the desired temperature. It is preferred that the fluidized bed 256 have a density of from about 30 to about 50 pounds per cubic foot and an operating temperature of from about 215 to about 250 degrees Fahrenheit. In one embodiment, the temperature of fluidized bed 256 is maintained at from about 225 to about 250 degrees Fahrenheit.

One may dispose one or more sensors, such as sensor 30, within fluidized bed 256 to monitor its temperature and density. When, e.g., the temperature of fluidized bed is outside of the desired range, one may add more water. When, e.g., the density of the fludized bed is outside of the desired range, one may adjust the feed rate of the inert gas.

Referring again to FIG. 3, dried coal is withdrawn from line 264 and fed to a desulfurization assembly 266. The dried coal may be desulfurized by any of the conventional coal desulfurization processes and apparatuses such as, e.g., those disclosed in U.S. Pat. Nos. 5,538,703, 5,517,930, 5,509,945, 5,494,880, 5,458,659, 5,350,431, 5,217,503, 5,094,668, 4,886,522, and the like. The disclosure of each of these United States patents is hereby incorporated by reference into this specification.

Figure 6:
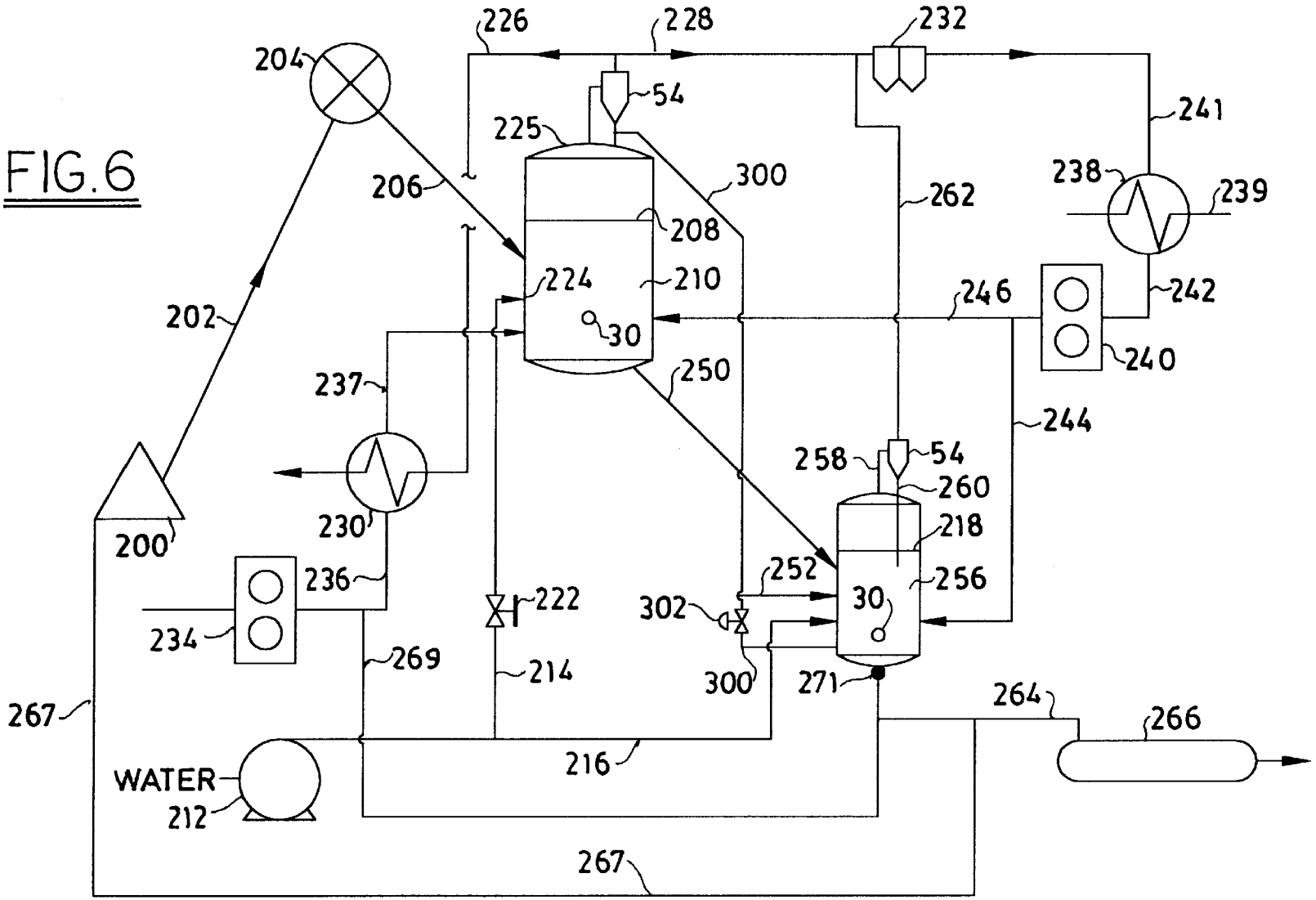
FIG. 6 is a schematic representation of yet another preferred process for processing coal.

In one preferred embodiment, illustrated in FIG. 6, raw coal from coal source 200 is fed via line 267 to line 264, wherein the raw coal is mixed with the dried coal from vessel 218. In general, from about 2 to about 5 weight percent of such raw coal (by total weight of raw coal and dried coal) is mixed with the dried coal in line 264.

The mixing of the raw coal with the dried coal generally reduces the temperature of the mixture to from about 125 to about 150 degrees Fahrenheit. Without be bound by any particular theory, applicants believe that, because the raw coal contains a substantial amount of moisture (generally from about 20 to about 30 percent), the vaporization of this moisture serves to reduce the temperature of the mixture. What is clear, however, is that the reduction of the temperature of the dried coal reduces the risk of autoignition.

In one embodiment, illustrated in FIG. 6, air is added via lines 236 and 269 to the point of withdrawal 271 at which solids are being withdrawn from vessel 218. The recycle gases within vessel 218 often contain trace amounts (less than 1.0 volume percent) of carbon monoxide which can be eliminated by purging the withdrawn solids with air, thereby eliminating the safety hazard from the carbon monoxide.

In one preferred embodiment, the desulfurization unit 256 operates magnetically by attracting and removing ferromagnetic particles such as, e.g., pyritic sulfur. One may use any of the magnetic separators known to those skilled in the art such as, e.g., those disclosed in U.S. Pat. Nos. 5,622,265, 5,607,575, 5,543,041, 5,520,288, 4,496,470, and the like. The disclosure of each of these United States patents is hereby incorporated by reference into this specification.

A Preferred Reactor for Use in Applicants' Process

Figure 4:
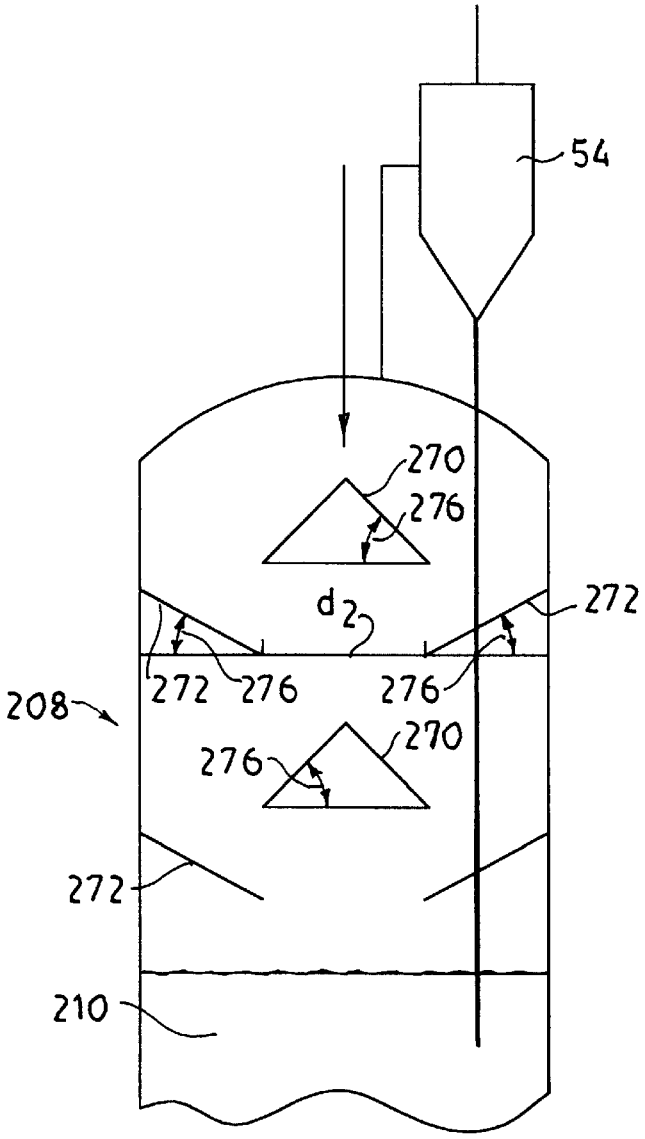
FIG. 4 is a schematic representation of a fludized bed reactor which may be used in the process of FIG. 3.

FIG. 4 is a schematic representation of one preferred fluidized bed reactor 208. Referring to FIG. 4, it will be seen that a multiplicity of discs 270 and donuts 272 are disposed above fluidized bed 210. In general, the distance which these units are disposed above fluidized bed 210 is at least about 3.0 feet, and preferably is no more than about 6.0 feet.

The discs 270 are preferably cone shaped and have internal angles 276 of from about 45 to about 60 degrees. These cone-shaped discs serve to direct the flow of coal obliquely onto the donuts 272 disposed below them.

Without wishing to be bound to any particular theory, applicants believe that the use of these discs and donuts partially dehydrates the coal particles and thus reduces the amount of water vapor present in the fluidized bed 210, increases the partial pressure of oxygen, and thus further enhances the reaction rate.

Figure 5:
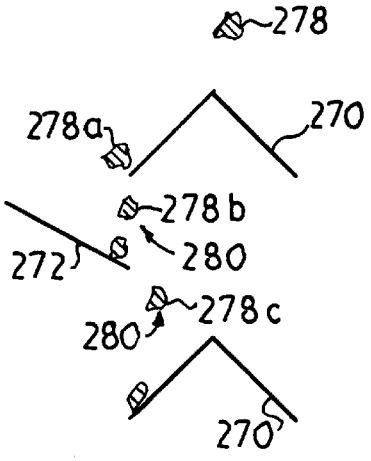
FIG. 5 is a schematic representation of the history of a particular coal particle within the fluidized bed reactor of FIG. 4.

FIG. 5 illustrates how one coal particle 278 might be affected by the discs and donuts. Referring to FIG. 5, it will be seen that coal particle 278 is deflected by disc 270, at which point it becomes coal particle 278*a*. Coal particle 278*a*, as it is falling from disc 270, contacts hot exhaust gas 280, at which point it loses some of tis water; at this point, the coal particle is identified as 278*b*.

Coal particle 278*b* further falls onto the surface of donut 272, which deflects it towards a second disc 270. As it is falling towards the second disc 270, it is again contacted by hot exhaust gas 280, again partially dehydrating it; at his point it is identified as coal particle 278*c*. Thereafter, the partially dehydrated coal particle falls into the fluidized bed.

Another Preferred Process of the Invention

Another preferred process of this invention is described in FIG. 6. In this preferred process, while coal is subjected in fluidized bed 210 to a temperature of from about 480 to about 600 degrees Fahrenheit, it is comminuted, thereby producing at least one coarse fraction and at least one fine fraction. As is deescribed elsewhere in this specification, at least a portion of said fine fraction is entrained to cyclone 54. In general, up to about 10 weight percent of the coal fed to bed 210 is may be sufficiently fine to be entrained to cyclone 54. At least about 80 weight percent of the coal particles smaller than 100 microns are generally entrained in cyclone 54.

Of the particles so entrained in cyclone 54, at least a portion of such particles is removed from the cyclone and fed to a cooler. In general, at least about 80 weight percent of the particles entrained in cyclone 54 are fed to the cooler.

The temperature of the particles which are fed to the cooler is generally reduced by at least about 300 degrees Fahrenheit and, preferably, by at least about 350 degrees Fahrenhiet.

Referring to FIG. 6, and the preferred embodiment depicted therein, it will be seen that fine material entrained in cyclone 54 are fed via line 300 to cooler 218. This entrained material is comprised of the finer particle size portion of fluidized bed 210 and generally as a particle size distribution such that at least about 50 weight percent of its particles are smaller than 100 microns. This entrained material is generally at a temperature of from about 480 to about 600 degrees Fahrenheit. Without being bound to any particular theory, applicants believe that this process step helps insure that the proper particle size distribution is produced in reactor 208.

The pressure within vessel 208 is generally higher than the pressure in vessel 218, and thus this pressure differential facilitates the transfer of the entrained material via line 300. Furthermore, as will be apparent, this pressure differential also facilitates the transfer of some fluidization gas from vessel 208 to vessel 218.

In general, it is preferred to have a pressure differential between vessel 208 and vessel 218 of at least about 2 pounds per square inch and, more preferably, at least about 4 pounds per square inch. In one embodiment, the pressure differential between vessel 208 and vessel 218 is at least about 5 pounds per square.

As will be apparent, the precise pressure in each of the reactors 208 and 218 will vary with a number of factors including, e.g., moisture content, gas content, gas feed rate, temperature, and the like. By varying these and other variables in accordance with established thermodynamic principles, one may achieve the desired pressure differential.

In one embodiment, the pressure within vessel 208 ranges from about 4 to about 10 pounds per square inch gauge (p.s.i.g.), whereas the pressure within vessel 218 ranges from about 2 to about 4 p.s.i.g.

Referring again to FIG. 6, and the preferred embodiment depicted therein, it will be seen that a flow control valve 302 controls the amount and rate of solid and gaseous material being fed via line 300 to vessel 218. As will be apparent to those skilled in the art, the desired rate is chosen to maintain the bed levels and bed conditions in reactors 208 and 216, which are interdependent.

Figure 7:
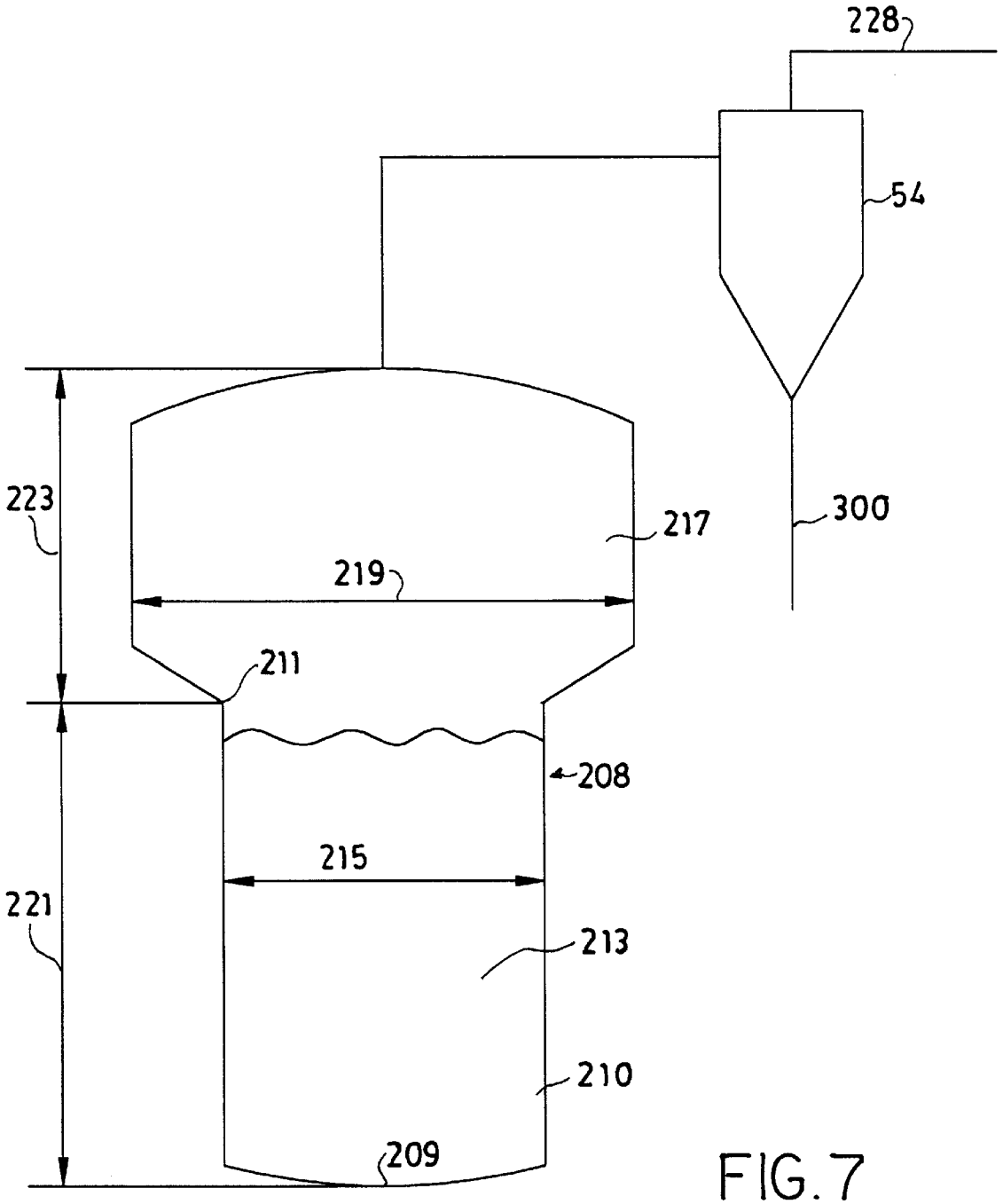
FIG. 7 is a schematic representation of a preferred fluidized bed reactor which can be used in the process depicted in FIG. 6.

FIG. 7 is a schematic representation of a preferred fluidized bed reactor 208 which may be used in the process depicted in FIG. 7.

Referring to FIG. 7, it will be seen that fluidized bed reactor 208 is comprised of a fluidized bed 210 which generally extends from the bottom 209 of the fluidized bed area 213 of the reactor to its top 211. The average width 215 of fluidized bed area 213 is preferably from about 10 to about 15 feet. In one preferred embodiment, fluidized bed area 213 has a substantially cylindrical shape, and thus its average diameter 215 is from about 10 to about 15 feet.

During operation, at least about 75 volume percent of the material within fluidized bed area 213 is solid material. By comparison, during such operation at least about 75 volume percent of the material within entrainment area 217 of the fluidized bed reactor 208 is gaseous.

The average width 219 of entrainment area 217 is from about 1.3 to about 1.5 times as great as average width 215; and it is preferably about 1.4 times as great as average width 215. In one preferred embodiment, both fluidized bed area 213 and entrainment area 217 have substantially cylindrical shapes, in which cases average widths 215 and 219 are both average diameters.

Referring again to FIG. 7, and in the preferred embodiment depicted therein, it will be seen that fluidized bed area 213 has a height 221 of from about 1.5 to about 2.0 times as great as its width 215. Entrainment area 219 has a height 223 of from about 0.7 to about 1.0 times width 215. It is preferred that height 221 be from about 1.8 to about 2.2 times as great as height 223 and, more preferably, be from about 1.9 to about 2.1 times as great as such height 223.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A process for preparing an irreversibly dried coal, comprising the steps of:

(a) providing a first fluidized bed reactor comprised of a first fluidized bed with a fluidized bed density of from about 30 to about 50 pounds per cubic foot, wherein said first fluidized bed is maintained at a temperature of from about 480 to about 600 degrees Fahrenheit, (b) feeding to said first fluidized bed coal with a moisture content of from about 15 to about 30 percent and a particle size such that all of the coal particles in such coal are in the range of from 0 to 2 inches, (c) feeding to said first fluidized bed liquid phase water, inert gas, and air, and subjecting said coal in said first fluidized bed to a temperature of from about 480 to about 600 degrees Fahrenheit for from about 1 to about 5 minutes while simultaneously comminuting and dewatering said coal, wherein:

(i) while said coal is subjected in said first fluidized bed to said temperature of from about 480 to about 600 degrees Fahrenheit, it is comminuted, thereby producing at least one coarse fraction and at least one fine fraction, (ii) at least a portion of said fine fraction is entrained to a cyclone, and (iii) At least a portion of said fine fraction entrained to said cyclone is removed from said cyclone and fed to a cooler in which the temperature of said fine fraction is reduced by at least about 300 degrees Fahrenheit, (d) passing said comminuted and dewatered coal to a second fluidized bed reactor comprised of a second fluidized bed with a fluidized bed density of from about 30 to about 50 pounds per cubic foot, wherein said second fluidized bed is at a temperature of from about 215 to about 250 degrees Fahrenheit, wherein water, inert gas, and from about 0.5 to about 3.0 weight percent of mineral oil with an initial boiling point of at least about 900 degrees Fahrenheit is also fed to said second fluidized bed, and (e) reducing the temperature of said comminuted and dewatered coal from said temperature of from about 480 to about 600 degrees Fahrenheit to said temperature of from about 215 to about 250 degrees Fahrenheit in less than about 120 seconds.

2. The process as recited in claim 1, wherein dried coal is withdrawn from said second fluidized bed reactor.

3. The process as recited in claim 2, coal with a moisture content of from about 15 to about 30 weight percent is mixed with said dried coal.

4. The process as recited in claim 3, wherein from about 2 to about 5 weight percent of said coal with a moisture content of from about 15 to about 30 weight percent is mixed with said dried coal.

5. The process as recited in claim 1, wherein said coal has a moisture content of from about 20 to about 30 weight percent.

6. The process as recited in claim 1, wherein said coal is comprised of at least about 10 weight percent of combined oxygen.

7. The process as recited in claim 3, wherein said coal is comprised of from about 10 to about 20 weight percent of combined oxygen.

8. The process as recited in claim 1, wherein said coal is comprised of at least about 10 weight percent of ash.

9. The process as recited in claim 1, wherein said coal in said first fluidized bed is subjected to a temperature of from about 550 to about 600 degrees Fahrenheit for from about 1 to about 5 minutes.

10. The process as recited in claim 1, wherein a sensor is disposed within said first fluidized bed.

11. The process as recited in claim 1, further comprising the step of entraining a fine coal portion from said first fluidized bed.

12. The process as recited in claim 1, wherein said air which is fed to said first fluidized bed is heated to a temperature of from about 400 to about 550 degrees Fahrenheit.

13. The process as recited in claim 1, where said air which is fed to said first fluidized bed is heated to a temperature of from about 450 to about 500 degrees Fahrenheit.

14. The process as recited in claim 1, wherein said inert gas is exhaust gas.

15. The process as recited in claim 1, wherein the temperature of said comminuted and dewatered coal is reduced from said temperature of from about 480 to about 600 degrees Fahrenheit to said temperature of from about 215 to about 250 degrees Fahrenheit in less than about 60 seconds.

16. The process as recited in claim 1, wherein said second fluidized bed is maintained at a temperature of from about 225 to about 250 degrees Fahrenheit.

17. The process as recited in claim 1, further comprising the step of desulfurizing said comminuted and dewatered coal.

18. The process as recited in claim 1, wherein said first fluidized bed reactor is comprised of a multiplicity of discs disposed above said fluidized bed of said first fludized bed reactor.

19. The process as recited in claim 15, comprising the step of dehydrating said coal prior to the time it contacts said first fluidized bed.

20. The process as recited in claim 1, wherein said first fluidized bed reactor is comprised of a fluidized bed area and an entrainment area, wherein:

(a) the width of said fluidized bed area is from about 10 to about 15 feet, (b) the width of said entrainment area is from about 1.3 to about 1.5 times as great as said width of said fluidized bed area, (c) the height of said fluidized bed area is from about 1.5 to about 2 times as great as said width of said fluidized bed area, and (d) the height of said entrainment area is from about 0.7 to about 1 times as great as said width of said fluidized bed area.

* * * * *